US010753359B2

(12) United States Patent
Crum et al.

(10) Patent No.: US 10,753,359 B2
(45) Date of Patent: Aug. 25, 2020

(54) SCROLL COMPRESSOR SHAFT

(71) Applicant: TRANE INTERNATIONAL INC., Davidson, NC (US)

(72) Inventors: Daniel R. Crum, Huntersville, NC (US); Kenneth Andrew Raymond, Rochester, MN (US); George Hansen, Onalaska, WI (US); Michael G. Benco, Onalaska, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 335 days.

(21) Appl. No.: 15/664,961

(22) Filed: Jul. 31, 2017

(65) Prior Publication Data

US 2019/0032664 A1 Jan. 31, 2019

(51) Int. Cl.

| | |
|---|---|
| ***F04C 18/02*** | (2006.01) |
| ***F04C 29/02*** | (2006.01) |
| ***F04C 23/00*** | (2006.01) |
| ***F04C 29/00*** | (2006.01) |

(52) U.S. Cl.

CPC ..... *F04C 18/0215* (2013.01); *F04C 23/008* (2013.01); *F04C 29/0057* (2013.01); *F04C 29/023* (2013.01); *F04C 2240/603* (2013.01); *F04C 2240/805* (2013.01)

(58) Field of Classification Search

CPC ..... F04C 18/0215; F04C 2240/603; F04C 2240/805; F04C 29/0057; F04C 29/023

See application file for complete search history.

(56) References Cited

U.S. PATENT DOCUMENTS

| | | | | |
|---|---|---|---|---|
| 4,488,855 | A | 12/1984 | Butterworth et al. | |
| 4,493,226 | A | 1/1985 | Andrione et al. | |
| 4,877,381 | A | 10/1989 | Johnson et al. | |
| 5,026,262 | A | 6/1991 | Baumann et al. | |
| 5,056,336 | A * | 10/1991 | Harrison | F04C 18/0215 418/55.2 |
| 5,104,302 | A | 4/1992 | Richardson, Jr. | |
| 5,343,777 | A | 9/1994 | Wood et al. | |
| 5,366,360 | A | 11/1994 | Bookbinder et al. | |
| 5,498,143 | A | 3/1996 | Dreiman et al. | |
| 6,129,530 | A | 10/2000 | Shaffer | |
| 6,139,294 | A | 10/2000 | Haller | |

(Continued)

*Primary Examiner* — Mary Davis

(74) *Attorney, Agent, or Firm* — Hamre, Schumann, Mueller & Larson, P.C.

(57) ABSTRACT

A crankshaft assembly for a scroll compressor is disclosed. The crankshaft assembly includes a crankpin having a plurality of apertures therethrough. A crankshaft body has an aperture therethrough. The aperture of the crankshaft and one of the plurality of apertures of the crankpin being aligned when in an assembled state such that in operation fluid flows between the aperture of the crankshaft body and the one of the plurality of apertures of the crankpin. The crankshaft body includes a second aperture aligned with a second of the plurality of apertures of the crankpin. The crankpin and the crankshaft body are separate members. A fastener extends through the second of the plurality of apertures of the crankpin and into the second aperture of the crankshaft body to secure the crankpin and the crankshaft body together in the assembled state.

16 Claims, 7 Drawing Sheets

(56) References Cited

U.S. PATENT DOCUMENTS

| | | | | |
|---|---|---|---|---|
| 6,684,500 | B1 * | 2/2004 | Kohlhase | B23B 5/18 29/558 |
| 6,684,979 | B1 | 2/2004 | Nakazato et al. | |
| 7,150,609 | B2 | 12/2006 | Kiem et al. | |
| 7,455,508 | B2 | 11/2008 | Suefuji et al. | |
| 7,458,152 | B2 * | 12/2008 | Sato | F01C 1/0215 29/458 |

* cited by examiner

SCROLL COMPRESSOR SHAFT

FIELD

This disclosure relates generally to vapor compression systems. More specifically, this disclosure relates to a crankshaft for a scroll compressor in a vapor compression system such as, but not limited to, a heating, ventilation, air conditioning, and refrigeration (HVACR) system.

BACKGROUND

One type of compressor for a vapor compression system is generally referred to as a scroll compressor. Scroll compressors generally include a pair of scroll members which orbit relative to each other to compress a working fluid such as, but not limited to, air or refrigerant. A typical scroll compressor includes a first, stationary scroll member having a base and a generally spiral wrap extending from the base; and a second, orbiting scroll member having a base and a generally spiral wrap extending from the base. The spiral wraps of the stationary scroll member and the orbiting scroll member are interleaved, creating a series of compression chambers. The orbiting scroll member is driven to orbit the stationary scroll member by rotating a crankshaft. Some scroll compressors employ an eccentric pin on the rotating crankshaft that drives the orbiting scroll member.

SUMMARY

This disclosure relates generally to vapor compression systems. More specifically, this disclosure relates to a crankshaft for a scroll compressor in a vapor compression system such as, but not limited to, a heating, ventilation, air conditioning, and refrigeration (HVACR) system.

A crankshaft assembly for a scroll compressor is disclosed. The crankshaft assembly includes a crankpin having a plurality of apertures therethrough. A crankshaft body has an aperture therethrough. The aperture of the crankshaft and one of the plurality of apertures of the crankpin being aligned when in an assembled state such that in operation, fluid flows between the aperture of the crankshaft body and the one of the plurality of apertures of the crankpin. The crankshaft body includes a second aperture aligned with a second of the plurality of apertures of the crankpin. The crankpin and the crankshaft body are separate members. A fastener extends through the second of the plurality of apertures of the crankpin and into the second aperture of the crankshaft body to secure the crankpin and the crankshaft body together in the assembled state.

In an embodiment, the crankpin and the crankshaft body are made of one of a turned, ground, and polished (TGP) and a drawn, ground, and polished (DGP) material.

In an embodiment, the crankshaft assembly is hardened. In an embodiment, the hardening is accomplished via a laser hardening process. In an embodiment, the crankshaft assembly can be hardened after the crankpin and crankshaft body are assembled together. In an embodiment, the crankpin and the crankshaft body can be separately hardened prior to assembly.

In an embodiment, the crankshaft assembly is a crankshaft for a scroll compressor.

A heating, ventilation, air conditioning, and refrigeration (HVACR) system is also disclosed. The HVACR system includes a compressor, condenser, expansion device, and evaporator fluidly connected to form a refrigerant circuit, wherein the compressor is a scroll compressor, the scroll compressor including a crankshaft assembly. The crankshaft assembly includes a crankpin having a plurality of apertures therethrough. A crankshaft body has an aperture therethrough. The aperture of the crankshaft and one of the plurality of apertures of the crankpin being aligned when in an assembled state such that in operation fluid flows between the aperture of the crankshaft body and the one of the plurality of apertures of the crankpin. The crankshaft body includes a second aperture aligned with a second of the plurality of apertures of the crankpin. The crankpin and the crankshaft body are separate members. A fastener extends through the second of the plurality of apertures of the crankpin and into the second aperture of the crankshaft body to secure the crankpin and the crankshaft body together in the assembled state.

BRIEF DESCRIPTION OF THE DRAWINGS

References are made to the accompanying drawings, which form a part of this disclosure, and which illustrate embodiments in which the systems and methods described in this specification can be practiced.

Like reference numbers represent like parts throughout.

DETAILED DESCRIPTION

This disclosure relates generally to vapor compression systems. More specifically, this disclosure relates to a crankshaft for a scroll compressor in a vapor compression system such as, but not limited to, a heating, ventilation, air conditioning, and refrigeration (HVACR) system.

A compressor (e.g., a scroll compressor) can include a crankshaft (sometimes alternatively referred to as a driveshaft or the like). The crankshaft can be rotatably driven so that the crankshaft mechanically powers a compression mechanism of the compressor. Generally, the crankshaft for scroll compressors is a single piece of material that includes a crankpin portion and a shaft portion. The crankpin portion and the shaft portion may not have the same diameter. The crankpin portion and the shaft portion can be offset so that a center of the crankpin portion and a center of the crankshaft portion are not aligned. When manufacturing the crankshaft, material may be removed (e.g., via a machining process such as a grinding and/or a turning process, etc.) to reach the final structure. Manufacturing the crankshaft can be time consuming and can waste material, as the starting material is selected to be sized to accommodate the various diameters, offset, or the like.

In an embodiment, a crankshaft for a compressor, such as a scroll compressor, may be manufactured as a crankshaft assembly, with a crankpin and a crankshaft body that are separately manufactured, and fastened together. In an embodiment, such a crankshaft assembly can, for example, reduce an amount of material consumed to produce the crankshaft assembly. In an embodiment, such a crankshaft assembly can, for example, be relatively quicker to manufacture than a single-piece crankshaft. In an embodiment, accuracy of the crankpin in a multi-piece crankshaft can be increased relative to a crankpin for a single-piece crankshaft because the crankpin is manufactured from a separate piece of material, as opposed to being turned and/or ground to its final structure.

In an embodiment, a crankshaft assembly as described in this specification may be easier to assemble in a scroll compressor than a single-piece crankshaft.

Figure 1:
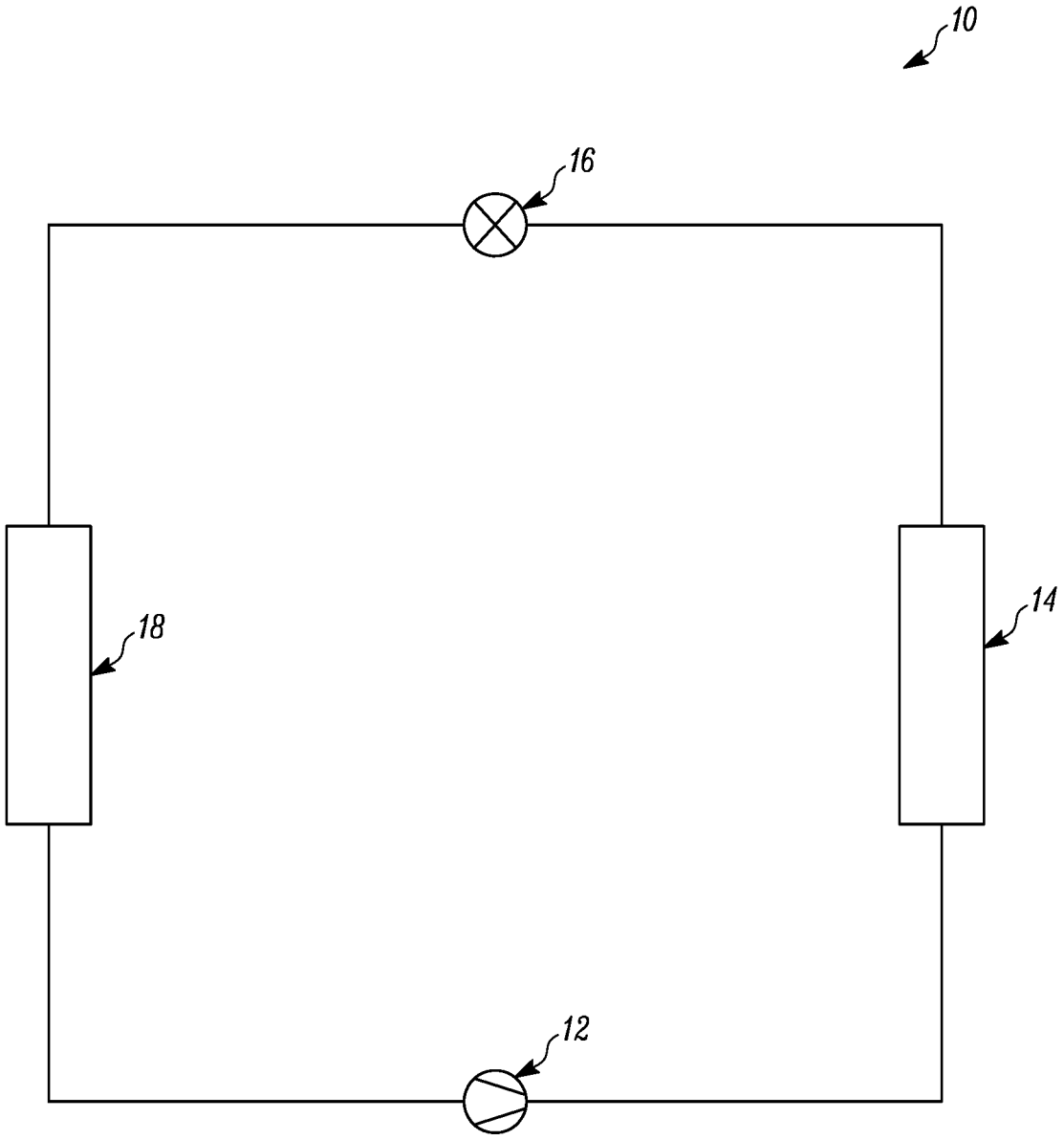
FIG. 1 is a schematic diagram of a refrigeration circuit, according to an embodiment.

FIG. 1 is a schematic diagram of a refrigerant circuit 10, according to an embodiment. The refrigerant circuit 10 generally includes a compressor 12, a condenser 14, an expansion device 16, and an evaporator 18. The compressor 12 can be, for example, a scroll compressor such as the scroll compressor shown and described in accordance with FIGS. 2-4 below. The refrigerant circuit 10 is an example and can be modified to include additional components. For example, in an embodiment, the refrigerant circuit 10 can include other components such as, but not limited to, an economizer heat exchanger, one or more flow control devices, a receiver tank, a dryer, a suction-liquid heat exchanger, or the like.

The refrigerant circuit 10 can generally be applied in a variety of systems used to control an environmental condition (e.g., temperature, humidity, air quality, or the like) in a space (generally referred to as a conditioned space). Examples of such systems include, but are not limited to, HVACR systems, transport refrigeration systems, or the like.

The compressor 12, condenser 14, expansion device 16, and evaporator 18 are fluidly connected. In an embodiment, the refrigerant circuit 10 can be configured to be a cooling system (e.g., an air conditioning system) capable of operating in a cooling mode. In an embodiment, the refrigerant circuit 10 can be configured to be a heat pump system that can operate in both a cooling mode and a heating/defrost mode.

The refrigerant circuit 10 can operate according to generally known principles. The refrigerant circuit 10 can be configured to heat or cool a liquid process fluid (e.g., a heat transfer fluid or medium such as, but not limited to, water or the like), in which case the refrigerant circuit 10 may be generally representative of a liquid chiller system. The refrigerant circuit 10 can alternatively be configured to heat or cool a gaseous process fluid (e.g., a heat transfer medium or fluid such as, but not limited to, air or the like), in which case the refrigerant circuit 10 may be generally representative of an air conditioner or heat pump.

In operation, the compressor 12 compresses a working fluid (e.g., a heat transfer fluid such as a refrigerant or the like) from a relatively lower pressure gas to a relatively higher-pressure gas. The relatively higher-pressure gas is also at a relatively higher temperature, which is discharged from the compressor 12 and flows through the condenser 14. The working fluid flows through the condenser 10 and rejects heat to a process fluid (e.g., water, air, etc.), thereby cooling the working fluid. The cooled working fluid, which is now in a liquid form, flows to the expansion device 16. The expansion device 16 reduces the pressure of the working fluid. As a result, a portion of the working fluid is converted to a gaseous form. The working fluid, which is now in a mixed liquid and gaseous form flows to the evaporator 18. The working fluid flows through the evaporator 18 and absorbs heat from a process fluid (e.g., water, air, etc.), heating the working fluid, and converting it to a gaseous form. The gaseous working fluid then returns to the compressor 12. The above-described process continues while the refrigerant circuit is operating, for example, in a cooling mode (e.g., while the compressor 12 is enabled).

Figure 2:
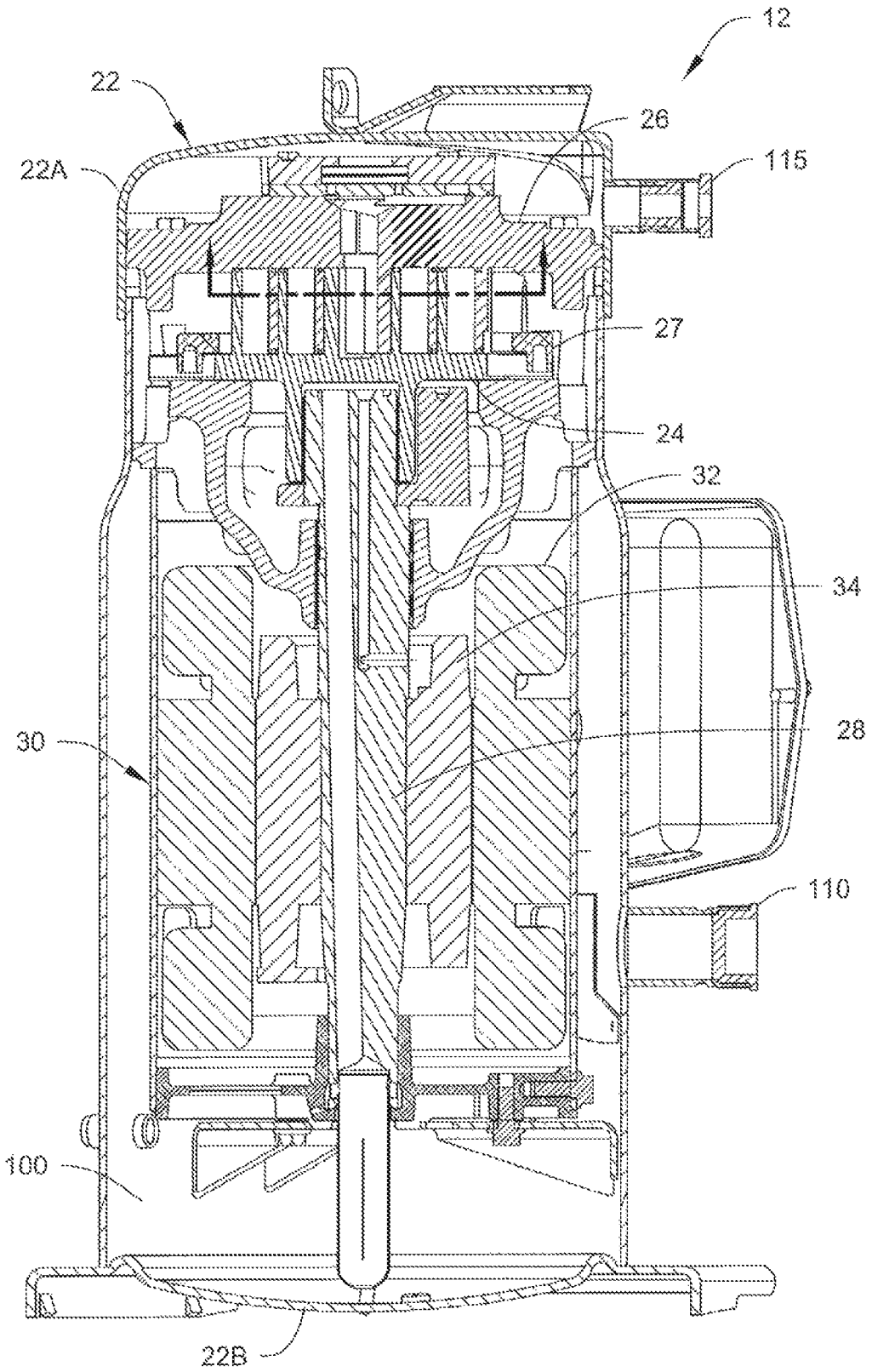
FIG. 2 is a schematic diagram of a scroll compressor, according to an embodiment.

FIG. 2 illustrates a sectional view of the compressor 12 with which embodiments as disclosed in this specification can be practiced, according to an embodiment. The compressor 12 can be used in the heat transfer circuit 10 of FIG. 1. It is to be appreciated that the compressor 12 can also be used for purposes other than in a heat transfer circuit. For example, the compressor 12 can be used to compress air or gases other than a heat transfer fluid (e.g., natural gas, etc.). It is to be appreciated that the scroll compressor 12 includes additional features that are not described in detail in this specification. For example, the scroll compressor 12 includes a lubricant sump 100 for storing lubricant to be introduced to the moving features of the scroll compressor 12.

The illustrated compressor 12 is a single-stage scroll compressor. More specifically, the illustrated compressor 12 is a single-stage vertical scroll compressor. It is to be appreciated that the principles described in this specification are not intended to be limited to single-stage scroll compressors and that they can be applied to multi-stage scroll compressors having two or more compression stages. Generally, the embodiments as disclosed in this specification are suitable for a compressor with a vertical or a near vertical crankshaft (e.g., crankshaft 28). It is to be appreciated that the embodiments may also be applied to a horizontal compressor.

The compressor 12 is illustrated in sectional side view. The scroll compressor 12 includes an enclosure 22. The enclosure 22 includes an upper portion 22A and a lower portion 22B. The compressor 12 includes a suction inlet 110 and a discharge outlet 115.

The compressor 12 includes an orbiting scroll 24 and a non-orbiting scroll 26. The non-orbiting scroll 26 can alternatively be referred to as, for example, the stationary scroll 26, the fixed scroll 26, or the like. The non-orbiting scroll 26 is aligned in meshing engagement with the orbiting scroll 24 by means of an Oldham coupling 27.

The compressor 12 includes a crankshaft 28. The crankshaft 28 can alternatively be referred to as the driveshaft 28. The crankshaft 28 can be rotatably driven by, for example, an electric motor 30. The electric motor 30 can generally include a stator 32 and a rotor 34. The crankshaft 28 is fixed to the rotor 34 such that the crankshaft 28 rotates along with the rotation of the rotor 34. The electric motor 30, stator 32, and rotor 34 can operate according to generally known principles. The crankshaft 28 can, for example, be fixed to the rotor 34 via an interference fit or the like. The crankshaft 28 can, in an embodiment, be connected to an external electric motor, an internal combustion engine (e.g., a diesel engine or a gasoline engine), or the like. It will be appreciated that in such embodiments the electric motor 30, stator 32, and rotor 34 would not be present in the compressor 12.

The compressor 12 includes a lubricant sump 100. A portion of the crankshaft 28 can, for example, fluidly communicate with the lubricant sump 100.

Figure 3:
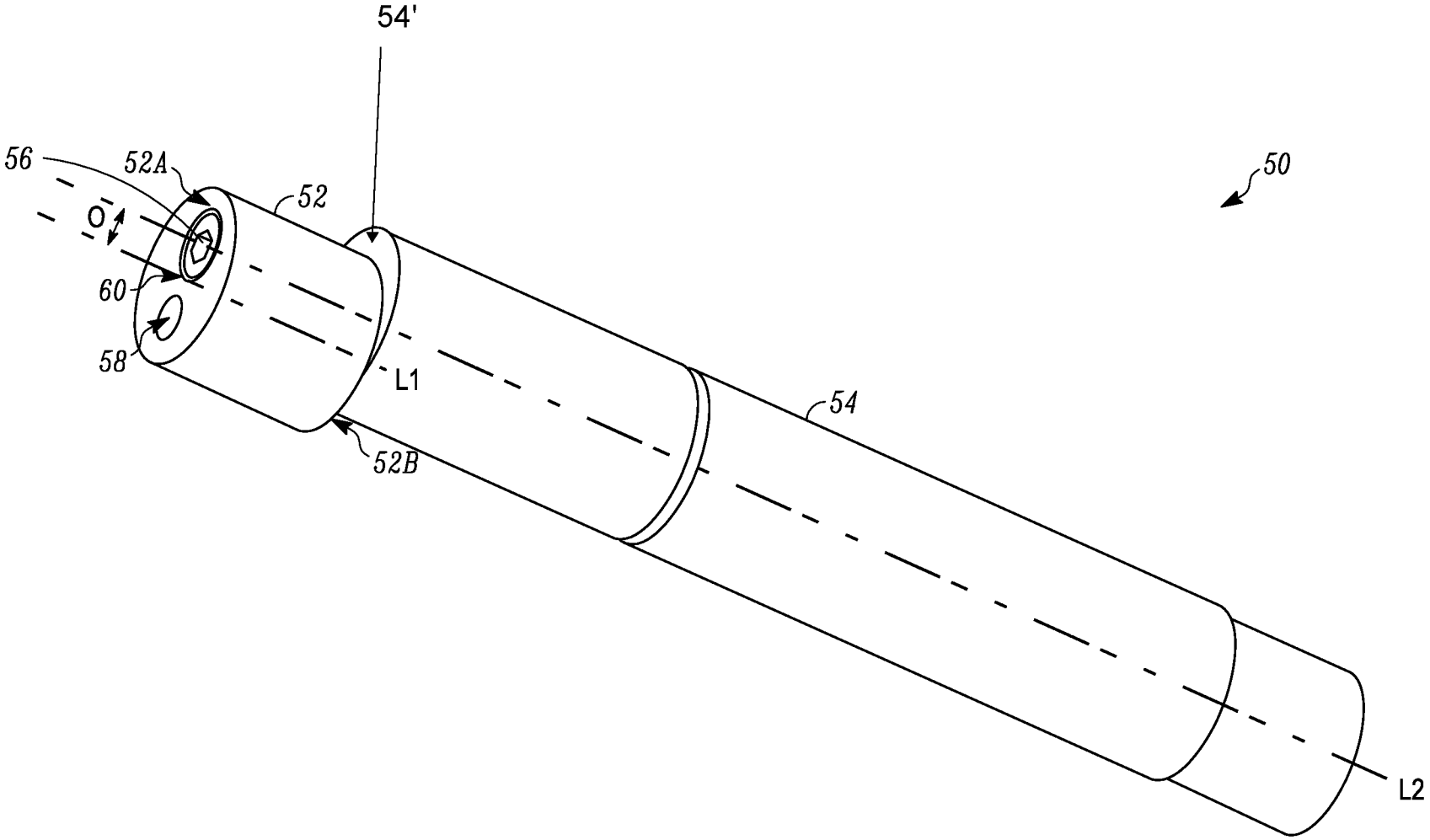
FIG. 3 is an isometric view of a crankshaft assembly, according to an embodiment.

FIG. 3 is an isometric view of a crankshaft assembly 50, according to an embodiment. The crankshaft assembly 50 can be utilized in the scroll compressor 12 (FIG. 2) as the crankshaft 28.

As illustrated, the crankshaft assembly 50 includes a crankpin 52 and a crankshaft body 54 secured together by a fastener 56. In an embodiment, the crankpin 52 and the crankshaft body 54 may be generally cylindrical, subject to, for example, manufacturing variations or the like. The crankpin 52 and the crankshaft body 54 are separate pieces of material. Manufacturing of the crankshaft assembly 50 can, for example, be relatively simpler (e.g., cheaper, faster, etc.) compared to a crankshaft formed of a single piece of material. It will be appreciated that the crankpin 52 and the crankshaft body 54 can be made from separate pieces of the same material. That is, in an embodiment, both the crankpin 52 and the crankshaft body 54 may be made of steel bar stock or the like. In an embodiment, a same material may be selected since properties (e.g., manufacturability, elastic modulus, hardenability, etc.) beneficial for one would be beneficial for the other. In an embodiment, the crankpin 52 and the crankshaft body 54 can be made of a turned, ground, and polished (TGP) material. In an embodiment, the crankpin 52 and the crankshaft body 54 can be made of a drawn, ground, and polished (DGP) material. In an embodiment, the crankpin 52 and the crankshaft body 54 can be made of different materials. That is, in an embodiment, the crankpin 52 can be made of a first steel bar stock or the like, and the crankshaft body 54 can be made of a second steel bar stock or the like.

In an embodiment, the TGP material and/or the DGP material can be subjected to a hardening process. A suitable example of a hardening process includes, but is not limited to, a low energy process such as laser heat treatment or the like. In an embodiment, a low energy process such as laser heat treatment can reduce an amount of distortion to the crankshaft assembly 50, which can reduce or eliminate a need for a post-heat treatment finishing process. In an embodiment, a nitrocarburizing heat treatment (e.g., ferritic or austenitic, etc.) may alternatively be used. In an embodiment utilizing a nitrocarburizing heat treatment, a polishing process may be performed following the heat treatment.

As shown in FIG. 3, the crankpin 52 and the crankshaft body 54 are offset relative to each other when in an assembled configuration. That is, a centerline L1 through a longitudinal axis of the crankpin 52 and a centerline L2 through a longitudinal axis of the crankshaft body 54 are not collinear. A distance O represents a distance between the centerline L1 and the centerline L2 and is representative of a distance by which the crankpin 52 and the crankshaft body 54 are offset. The crankshaft assembly 50 can accordingly be referred to as an offset crankshaft assembly 50.

Figure 5:
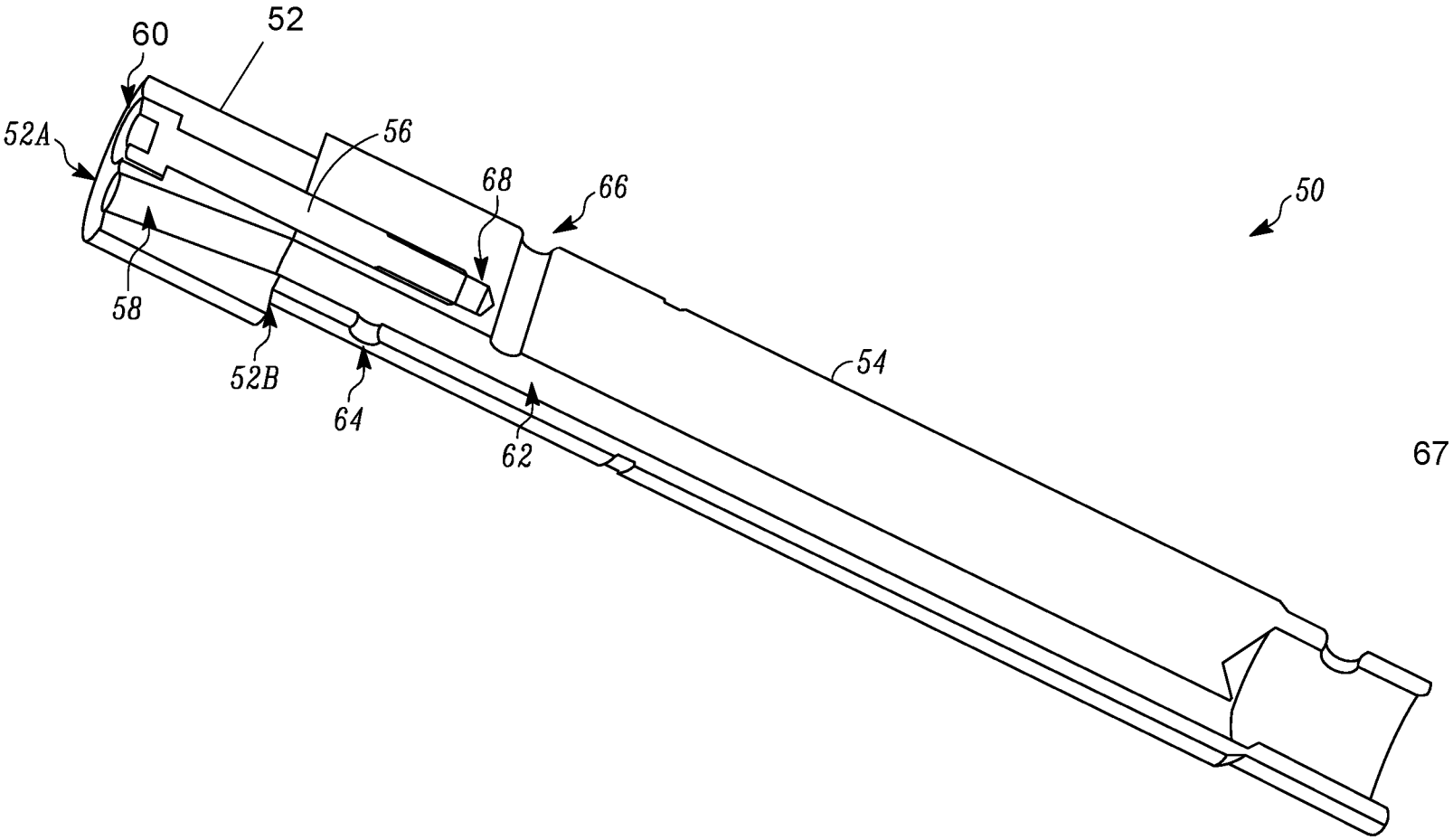
FIG. 5 is a cross-section of the crankshaft assembly of FIG. 3, according to an embodiment.

The crankpin 52 includes a plurality of apertures 58, 60. The apertures 58, 60 are visible at a surface 52A of the crankpin 52. The apertures 58, 60 can extend through the crankpin 52 from the surface 52A to opposite surface 52B (see FIG. 7). The extension of the apertures 58, 60 is not visible in FIG. 3, but is shown in FIG. 5.

The fastener 56 can be, for example, a bolt or the like. The fastener 56 is insertable through aperture 60 and can have a length that is greater than a length of the crankpin 52 such that a portion of the fastener 56 extends into an aperture formed in the crankshaft body 54.

Figure 4:
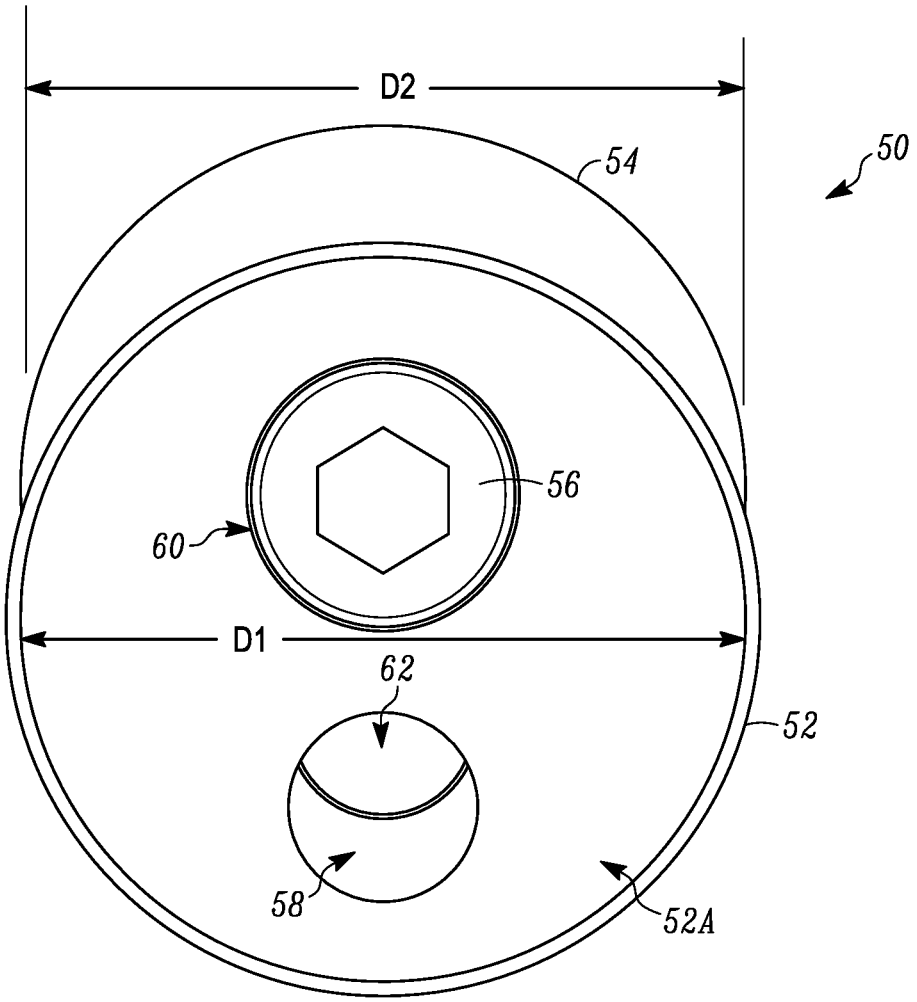
FIG. 4 is a top view of the crankshaft assembly of FIG. 3, according to an embodiment.

FIG. 4 is a top view of the crankshaft assembly 50 of FIG. 3, according to an embodiment. As illustrated in FIG. 4, an aperture 62 is formed in the crankshaft body 54. The aperture 62 can be disposed such that the aperture 58 in the crankpin 52 and the aperture 62 in the crankshaft body 54 are connected to enable fluid communication between the apertures 58 and 62. This can also be seen in the cross-sectional view of the crankshaft assembly 50 shown in FIG. 5 below. In operation, apertures 58 and 62 can receive a lubricant from a lubricant sump 100 (FIG. 2) of the compressor 12 (FIG. 2). As a result, in operation, lubricant can be provided to one or more bearings of the scroll compressor 12 via the apertures 58 and 62.

The crankpin 52 has a diameter D1 and the crankshaft body 54 has a diameter D2. In an embodiment, the diameters D1 and D2 can be the same or substantially similar to each other subject to, for example, manufacturing tolerances or the like. In an embodiment, the diameters D1 and D2 can be selected based on a stock diameter of a TGP or DGP stock material. In an embodiment, the diameters D1 and D2 may be determined by, for example, the compressor 12 with which the crankshaft assembly 50 is to be used. D1 and D2 may be determined based on bearing oil film calculations and a desired bearing oil film. According to a desired bearing oil film, a commercially produced TGP or DGP bar having a closest diameter to the D1 and D2 determined from the bearing oil film calculations can be selected. A load on the crankpin 52 and the crankshaft body 54 and/or geometry and/or area of the crankpin 52 and crankshaft body 54 may be different from each other.

FIG. 5 is a cross-section taken through a centerline of the crankshaft assembly 50, according to an embodiment. The apertures 58 and 62 are visible in additional detail in FIG. 5. As discussed above, FIG. 5 illustrates the aperture 58 as extending from the surface 52A to the surface 52B of the crankpin 52. As also illustrated in FIG. 5, the aperture 62 extends along a length of the crankshaft body 54. A lubricant aperture 64 can extend from a cylindrical outer surface of the crankshaft body 54 to the aperture 62. The lubricant aperture 64 is disposed such that the aperture 62 and the lubricant aperture 64 can be fluidly connected. For example, in operation, a lubricant can be provided to a bearing of the compressor 12 via the lubricant aperture 64 as received from the aperture 62. The lubricant aperture 64 can accordingly be disposed along a length of the crankshaft body 54 at a location at which the bearing would receive lubricant distributed via the lubricant aperture 64. The crankshaft body 54 can also include an aperture 66. The aperture 66 is disposed such that the aperture 66 extends from the cylindrical outer surface of the crankshaft body 54 to the aperture 62. The aperture 66 is disposed such that the aperture 62 and the aperture 66 can be fluidly connected. The aperture 66 can provide a vent to relieve any working fluid (e.g., refrigerant) that is released from the lubricant stream in aperture 62. Lubricant generally does not flow out of the aperture 66 since it crosses the centerline of crankshaft body 54. Lubricant flows out of aperture 67 to feed a bearing (not shown) on a lower end of the crankshaft body 54.

An aperture 68 is shown in FIG. 5. The aperture 68 is a channel in the crankshaft body 54 that is configured to receive the fastener 56. In an embodiment in which the fastener 56 is, for example, a bolt, the aperture 68 can be threaded for engaging with threads of the bolt to secure the crankpin 52 and the crankshaft body 54 together.

Figure 6:
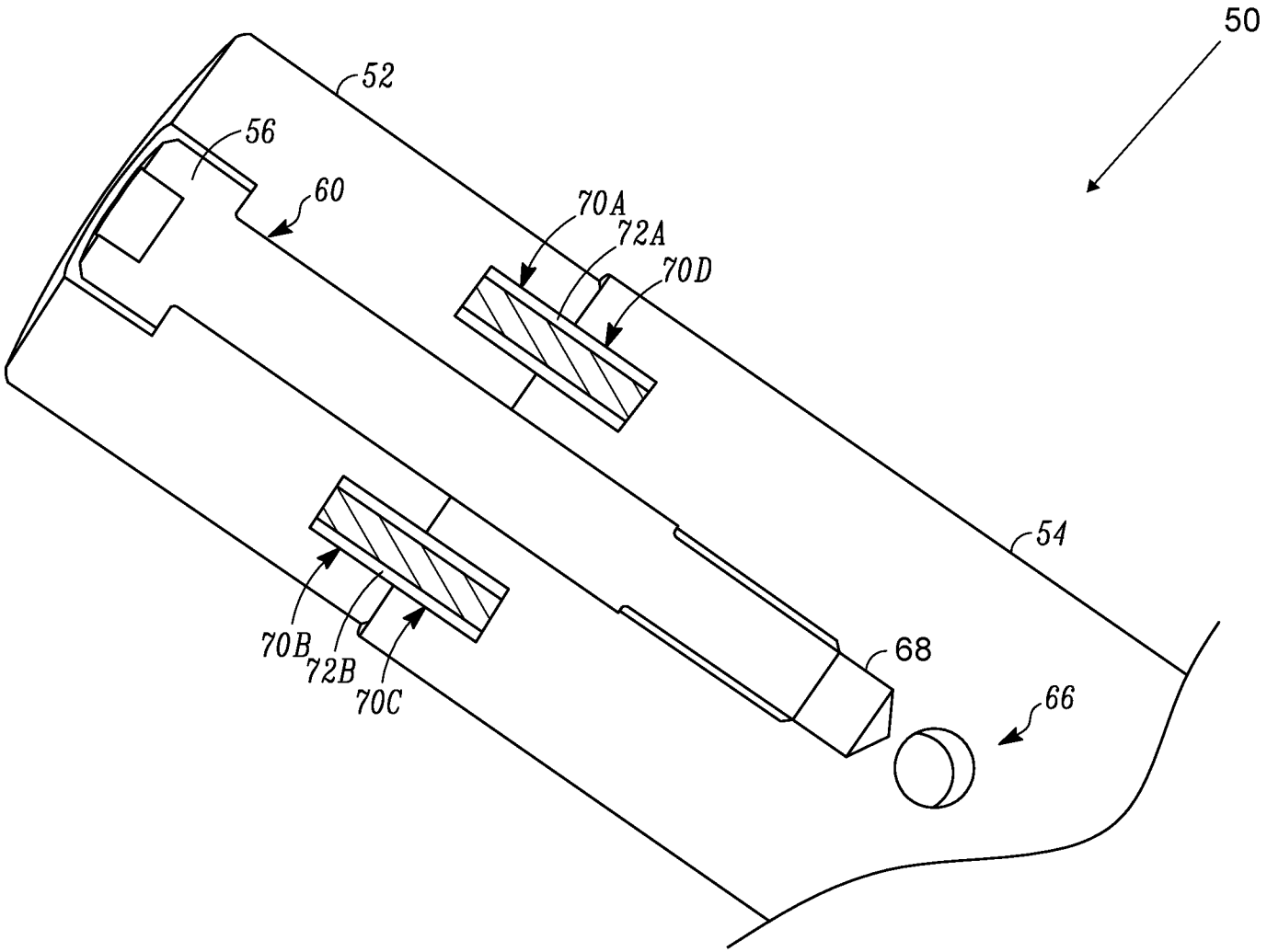
FIG. 6 is a cross-section of the crankshaft assembly of FIG. 3, according to an embodiment.

FIG. 6 is another cross-section of the crankshaft assembly that is 90° relative to the cross-section of FIG. 5, according to an embodiment. To assist with alignment of the crankpin 52 and the crankshaft body 54 during assembly, the crankpin 52 and the crankshaft body 54 can include a plurality of apertures 70A-70D. The plurality of apertures 70A-70D can be designed to receive aligning members 72A, 72B. In an embodiment, the aligning members 72A, 72B can be, for example, spring pins. In an embodiment, the aligning members 72A, 72B can be, for example, dowel pins or the like. The aligning members 72A, 72B can be used during assembly of the crankshaft assembly 50 to precisely position the crankpin 52 and crankshaft body 54.

Figure 7:
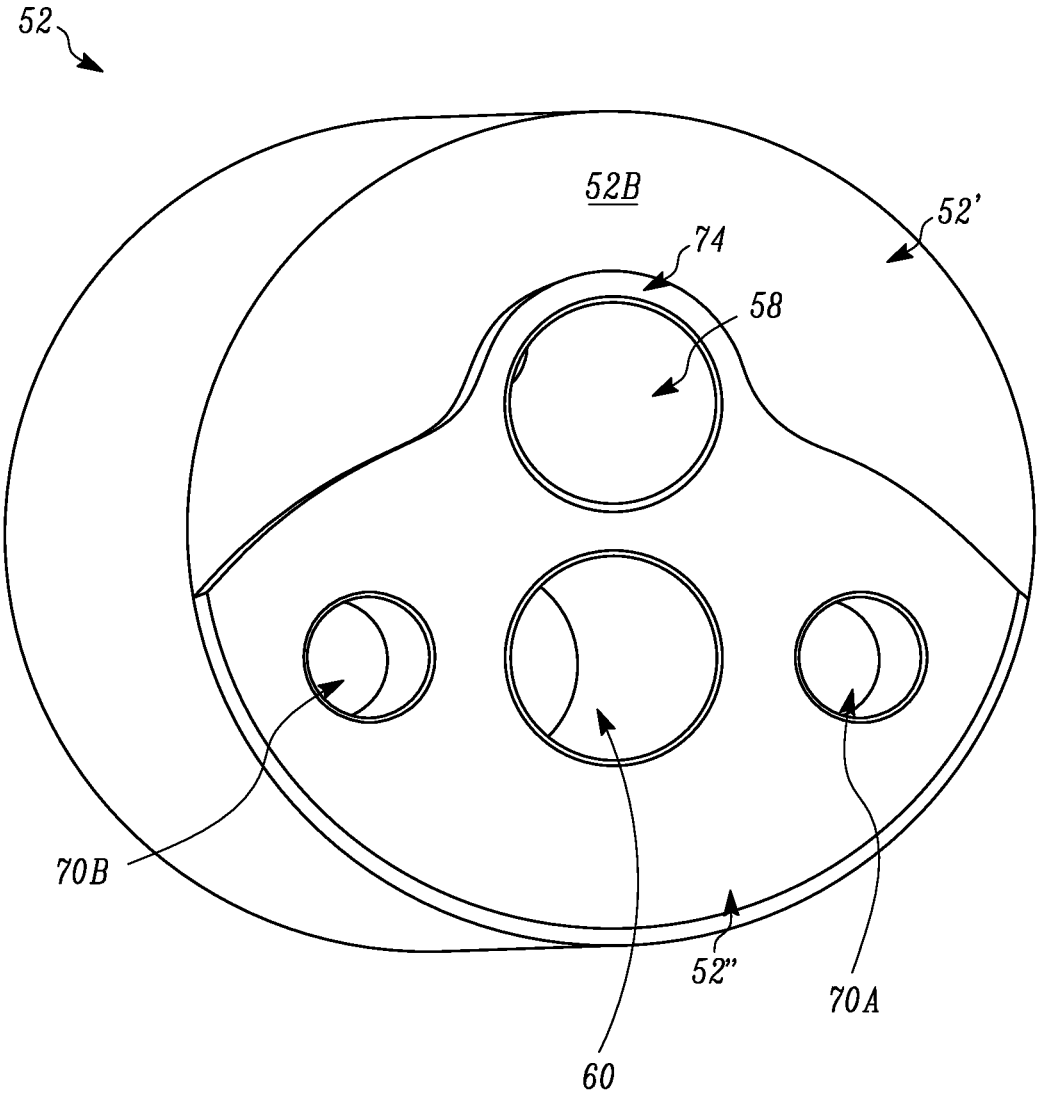
FIG. 7 is an isometric view of the crankpin, according to an embodiment.

FIG. 7 is an isometric view of the crankpin 52, according to an embodiment. In FIG. 7, the illustrated surface of the crankpin 52 is the surface 52B. As described above, the surface 52B is the surface of the crankpin 52 that is mated with a mating surface 54' (FIG. 3) of the crankshaft body 54. In an embodiment, the mating surface 54' can be a planar surface. The surface 52B can be divided into two surface portions 52' and 52". The surface portion 52" may alternatively be referred to as the mating surface 52". The surface portion 52' can be machined such that the surface portion 52" protrudes a distance further from the crankpin 52. The surface portion 52" accordingly contacts the mating surface 54' (FIG. 3) of the crankshaft body 54. The illustrated design shows a potential geometry for the surface portion 52". It will be appreciated that the specific configuration of the surface portion 52" can vary. The design can be selected, for example, to minimize an amount of distortion of the crankpin 52 when assembled to the crankshaft body 54. A region 74 of the surface portion 52" that surrounds at least a portion of the aperture 58 can also serve as a seal. In operation, the region 74 can additionally assist with preventing lubricant from leaking from an area at which the aperture 58 and the aperture 62 meet.

In an embodiment, the surface portion 52" can alternatively be a separate piece of material created via a thin metal stamping that could be assembled between the crankpin 52 and the crankshaft body 54. In such an embodiment, the surface 52B can be a single portion similar to 52'. In an embodiment, the stamped piece forming the protrusion 52", the surface 52B, and the mating surface 54' may be precisely machined to ensure that the mating faces are substantially flat to maintain centerlines L1 and L2 in a parallel configuration. In an embodiment, the stamping can be a relatively rigid material to prevent flexing and/or movement of the crankpin 52 relative to the crankshaft body 54.

In an embodiment, the surface 52B can be a planar surface and the mating surface 54' can be modified. In such an embodiment, the surface portion 52" could be disposed on the mating surface 54'. The embodiment including a modified mating surface 54' is not shown for simplicity of the specification. It will be appreciated that the mating surface 54' would be the same as or similar to the mating surface 52B in FIG. 7, but mirrored. It will also be appreciated that the variations discussed above with respect to the surface 52B would be applicable to an embodiment in which the mating surface 54' is modified.

Aspects

It is noted that any one of aspects 1-13 below can be combined with any one of aspects 14-25.

Aspect 1. A crankshaft assembly for a scroll compressor, comprising:

a crankpin having a plurality of apertures therethrough;

a crankshaft body having an aperture therethrough, the aperture of the crankshaft and one of the plurality of apertures of the crankpin being aligned when in an assembled state such that in operation fluid flows from the aperture of the crankshaft body and the one of the plurality of apertures of the crankpin, the crankshaft body including a second aperture, the second aperture of the crankshaft body being aligned with a second of the plurality of apertures of the crankpin, wherein the crankpin and the crankshaft body are separate members; and a fastener, extending through the second of the plurality of apertures of the crankpin and into the second aperture of the crankshaft body to secure the crankpin and the crankshaft body together in the assembled state.

Aspect 2. The crankshaft assembly according to aspect 1, further comprising a plurality of aligning members and a plurality of alignment apertures in the crankpin and the crankshaft body to align the crankpin and the crankshaft body when assembling the crankshaft assembly, the plurality of aligning members being disposed in the plurality of alignment apertures when in the assembled state.

Aspect 3. The crankshaft assembly according to any one of aspects 1 or 2, wherein the crankpin and the crankshaft body are made of one of a turned, ground, and polished (TGP) and a drawn, ground, and polished (DGP) material.

Aspect 4. The crankshaft assembly according to any one of aspects 1-3, wherein the crankshaft assembly is hardened.

Aspect 5. The crankshaft assembly according to aspect 4, wherein the crankshaft assembly is hardened via a laser hardening process.

Aspect 6. The crankshaft assembly according to aspect 4, wherein the crankpin and the crankshaft body are hardened before being assembled together.

Aspect 7. The crankshaft assembly according to any one of aspects 1-6, wherein the crankshaft body includes a plurality of apertures extending from a surface of the crankshaft body to the aperture of the crankshaft body.

Aspect 8. The crankshaft assembly according to any one of aspects 1-7, wherein the crankshaft assembly is an offset crankshaft in which a centerline through the crankshaft body and a centerline through the crankpin are not collinear.

Aspect 9. The crankshaft assembly according to any one of aspects 1-8, wherein the crankpin includes a mating surface and the crankshaft body includes a mating surface.

Aspect 10. The crankshaft assembly according to aspect 9, wherein one of the mating surface of the crankpin and of the mating surface of the crankshaft body includes a first surface portion and a second surface portion, the second surface portion extending from the one of the mating surface of the crankpin and of the mating surface of the crankshaft body.

Aspect 11. The crankshaft assembly according to aspect 10, wherein the second surface portion includes a region to seal the aperture of the crankshaft and the one of the plurality of apertures of the crankpin.

Aspect 12. The crankshaft assembly according to aspect 10, wherein the second surface portion is a separate piece of material secured to the one of the mating surface of the crankpin and of the mating surface of the crankshaft body.

Aspect 13. A scroll compressor, comprising the crankshaft assembly according to any one of aspects 1-12.

Aspect 14. A heating, ventilation, air conditioning, and refrigeration (HVACR) system, comprising:

a compressor, condenser, expansion device, and evaporator fluidly connected to form a refrigerant circuit, wherein the compressor is a scroll compressor, the scroll compressor including a crankshaft assembly, the crankshaft assembly including:

a crankpin having a plurality of apertures therethrough;

a crankshaft body having an aperture therethrough, the aperture of the crankshaft and one of the plurality of apertures of the crankpin being aligned when in an assembled state such that in operation fluid flows between the aperture of the crankshaft body and the one of the plurality of apertures of the crankpin, the crankshaft body including a second aperture, the second aperture of the crankshaft body being aligned with a second of the plurality of apertures of the crankpin, wherein the crankpin and the crankshaft body are separate members; and a fastener, extending through the second of the plurality of apertures of the crankpin and into the second aperture of the crankshaft body to secure the crankpin and the crankshaft body together in the assembled state.

Aspect 15. The HVACR system according to aspect 14, further comprising a plurality of aligning members and a plurality of alignment apertures in the crankpin and the crankshaft body to align the crankpin and the crankshaft body when assembling the crankshaft assembly, the plurality of aligning members being disposed in the plurality of alignment apertures when in the assembled state.

Aspect 16. The HVACR system according to any one of aspects 14 or 15, wherein the crankpin and the crankshaft body are made of one of a turned, ground, and polished (TGP) and a drawn, ground, and polished (DGP) material.

Aspect 17. The HVACR system according to any one of aspects 14-16, wherein the crankshaft assembly is hardened.

Aspect 18. The HVACR system according to aspect 17, wherein the crankshaft assembly is hardened via a laser hardening process.

Aspect 19. The HVACR system according to aspect 17, wherein the crankpin and the crankshaft body are hardened before being assembled together.

Aspect 20. The HVACR system according to any one of aspects 14-19, wherein the crankshaft body includes a plurality of apertures extending from a surface of the crankshaft body to the aperture of the crankshaft body.

Aspect 21. The HVACR system according to any one of aspects 14-20, wherein the crankshaft assembly is an offset crankshaft in which a centerline through the crankshaft body and a centerline through the crankpin are not collinear.

Aspect 22. The HVACR system according to any one of aspects 14-21, wherein one of the crankpin and of the crankshaft body includes a mating surface.

Aspect 23. The HVACR system according to aspect 22, wherein the mating surface includes a first surface portion and a second surface portion, the second surface portion extending from the mating surface.

Aspect 24. The HVACR system according to aspect 23, wherein the second surface portion seals the aperture of the crankshaft and the one of the plurality of apertures of the crankpin.

Aspect 25. The HVACR system according to aspect 23, wherein the second surface portion is a separate piece of material secured to the mating surface.

The terminology used in this specification is intended to describe particular embodiments and is not intended to be limiting. The terms "a," "an," and "the" include the plural forms as well, unless clearly indicated otherwise. The terms "comprises" and/or "comprising," when used in this specification, specify the presence of the stated features, integers, steps, operations, elements, and/or components, but do not preclude the presence or addition of one or more other features, integers, steps, operations, elements, and/or components.

With regard to the preceding description, it is to be understood that changes may be made in detail, especially in matters of the construction materials employed and the shape, size, and arrangement of parts without departing from the scope of the present disclosure. This specification and the embodiments described are exemplary only, with the true scope and spirit of the disclosure being indicated by the claims that follow.

What is claimed is:

1. A crankshaft assembly for a scroll compressor, comprising:

a crankpin having a plurality of apertures therethrough;

a crankshaft body having an aperture therethrough, the aperture of the crankshaft body and one of the plurality of apertures of the crankpin being aligned when in an assembled state such that in operation fluid flows between the aperture of the crankshaft body and the one of the plurality of apertures of the crankpin, the crankshaft body including a second aperture, the second aperture of the crankshaft body being aligned with a second of the plurality of apertures of the crankpin, wherein the crankpin and the crankshaft body are separate members; and a fastener, extending through the second of the plurality of apertures of the crankpin and into the second aperture of the crankshaft body, the fastener configured to secure the crankpin and the crankshaft body together in the assembled state, wherein the crankpin includes a first mating surface at an end of the crankpin and the crankshaft body includes a second mating surface at an end of the crankshaft body, the first mating surface contacting the second mating surface when the crankshaft is in the assembled state, one of the end of the crankpin and the end of the crankshaft body is planar, the other of the end of the crankpin or the end of the crankshaft body includes:

a first surface portion and a second surface portion, the second surface portion extending farther than the first surface portion from the other of the end of the crankpin or the end of the crankshaft body and includes a region configured to seal the aperture of the crankshaft body and the one of the plurality of apertures of the crankpin, wherein the second surface portion is one of the first mating surface when at the end of the crankpin or the second mating surface when at the end of the crankshaft body, and the crankshaft assembly is an offset crankshaft in which a centerline through the crankshaft body and a centerline through the crankpin are not collinear.

2. The crankshaft assembly according to claim 1, further comprising a plurality of aligning members and a plurality of alignment apertures in the crankpin and the crankshaft body to align the crankpin and the crankshaft body when assembling the crankshaft assembly, the plurality of aligning members being disposed in the plurality of alignment apertures when in the assembled state.

3. The crankshaft assembly according to claim 1, wherein the crankpin and the crankshaft body are made of one of a turned, ground, and polished (TGP) and a drawn, ground, and polished (DGP) material.

4. The crankshaft assembly according to claim 1, wherein the crankshaft assembly is hardened.

5. The crankshaft assembly according to claim 4, wherein the crankpin and the crankshaft body are hardened via a laser hardening process.

6. The crankshaft assembly according to claim 4, wherein the crankpin and the crankshaft body are hardened before being assembled together.

7. The crankshaft assembly according to claim 1, wherein the crankshaft body includes a plurality of apertures extending from a surface of the crankshaft body to the aperture of the crankshaft body.

8. The crankshaft assembly according to claim 1, wherein the first mating surface is formed on a separate piece of material from the crankpin, the separate piece of material secured to the crankpin.

9. A scroll compressor, comprising the crankshaft assembly according to claim 1.

10. A heating, ventilation, air conditioning, and refrigeration (HVACR) system, comprising:

a compressor, condenser, expansion device, and evaporator fluidly connected to form a refrigerant circuit, wherein the compressor is a scroll compressor, the scroll compressor including a crankshaft assembly, the crankshaft assembly including:

a crankpin having a plurality of apertures therethrough;

a crankshaft body having an aperture therethrough, the aperture of the crankshaft body and one of the plurality of apertures of the crankpin being aligned when in an assembled state such that in operation fluid flows between the aperture of the crankshaft body and the one of the plurality of apertures of the crankpin, the crankshaft body including a second aperture, the second aperture of the crankshaft body being aligned with a second of the plurality of apertures of the crankpin, wherein the crankpin and the crankshaft body are separate members; and a fastener, extending through the second of the plurality of apertures of the crankpin and into the second aperture of the crankshaft body, the fastener configured to secure the crankpin and the crankshaft body together in the assembled state, wherein the crankpin includes a first mating surface at an end of the crankpin and the crankshaft body includes a second mating surface at an end of the crankshaft body, the first mating surface contacting the second mating surface when the crankshaft is in the assembled state, one of the end of the crankpin and the end of the crankshaft body is planar, the other of the end of the crankpin or the end of the crankshaft body includes:

a first surface portion and a second surface portion, the second surface portion extending farther than the first surface portion from the other of the end of the crankpin or the end of the crankshaft body and includes a region configured to seal the aperture of the crankshaft body and the one of the plurality of apertures of the crankpin, wherein the second surface portion is one of the first mating surface when at the end of the crankpin or the second mating surface when at the end of the crankshaft body, and the crankshaft assembly is an offset crankshaft in which a centerline through the crankshaft body and a centerline through the crankpin are not collinear.

11. The HVACR system according to claim 10, further comprising a plurality of aligning members and a plurality of alignment apertures in the crankpin and the crankshaft body to align the crankpin and the crankshaft body when assembling the crankshaft assembly, the plurality of aligning members being disposed in the plurality of alignment apertures when in the assembled state.

12. The HVACR system according to claim 10, wherein the crankpin and the crankshaft body are made of one of a turned, ground, and polished (TGP) and a drawn, ground, and polished (DGP) material.

13. The HVACR system according to claim 10, wherein the crankshaft assembly is hardened.

14. The HVACR system according to claim 13, wherein the crankshaft assembly is hardened via a laser hardening process.

15. The HVACR system according to claim 10, wherein the crankshaft body includes a plurality of apertures extending from a surface of the crankshaft body to the aperture of the crankshaft body.

16. The HVACR system according to claim 10, wherein the first mating surface is formed on a separate piece of material from the crankpin, the separate piece of material secured to the crankpin.

* * * * *